US008220948B2

(12) United States Patent
Rong et al.

(10) Patent No.: US 8,220,948 B2
(45) Date of Patent: Jul. 17, 2012

(54) OPTICALLY EFFICIENT NOTIFICATION DEVICE FOR USE IN LIFE SAFETY CEILING STROBE APPLICATIONS

(75) Inventors: Wei Rong, Peachtree City, GA (US); Joseph Keller, Tinton Falls, NJ (US); Joseph Kosich, South Toms River, NJ (US); Crystal Pierz, Hazlet, NJ (US)

(73) Assignee: Cooper Technologies Company, Houston, TX (US)

( * ) Notice: Subject to any disclaimer, the term of this patent is extended or adjusted under 35 U.S.C. 154(b) by 389 days.

(21) Appl. No.: 12/559,006

(22) Filed: Sep. 14, 2009

(65) Prior Publication Data

US 2011/0063848 A1 Mar. 17, 2011

(51) Int. Cl.
*F21S 8/00* (2006.01)
*F21V 7/00* (2006.01)

(52) U.S. Cl. ..... 362/147; 362/297; 362/346; 362/404

(58) Field of Classification Search ..... 362/147, 362/297, 346, 404
See application file for complete search history.

(56) References Cited

U.S. PATENT DOCUMENTS

| | | | |
|---|---|---|---|
| 2,905,863 | A | 9/1959 | Martin et al. |
| 4,837,559 | A | 6/1989 | Green |
| 4,954,938 | A | 9/1990 | Lyons |
| 5,249,110 | A | 9/1993 | Russello et al. |
| 5,347,259 | A | 9/1994 | Jongewaard |
| 5,448,462 | A | 9/1995 | Moran, III |
| 5,475,361 | A | 12/1995 | Curran et al. |
| 5,546,293 | A | 8/1996 | Moran, III |
| 5,622,427 | A | 4/1997 | Lemons et al. |
| 5,684,467 | A | 11/1997 | Hur |
| 5,865,527 | A | 2/1999 | Lemons et al. |
| 5,914,665 | A | 6/1999 | Thorp et al. |
| 5,931,569 | A | 8/1999 | Anderson |
| 6,133,843 | A | 10/2000 | Davidson |
| 6,158,869 | A | 12/2000 | Barnes |
| 6,217,196 | B1 | 4/2001 | Kosich et al. |
| 6,243,001 | B1 | 6/2001 | Kodaka |
| 6,508,574 | B1 | 1/2003 | Sara et al. |
| 6,623,143 | B2 | 9/2003 | Anderson |
| 6,793,375 | B2 | 9/2004 | Anderson |
| 6,838,997 | B1 | 1/2005 | Davidson |
| 7,006,003 | B2 | 2/2006 | Zimmerman et al. |
| 7,261,440 | B2 | 8/2007 | Kwasny |
| RE39,900 | E | 10/2007 | Hein et al. |
| 2002/0085374 | A1 | 7/2002 | Anderson |
| 2003/0086269 | A1 | 5/2003 | Anderson |
| 2006/0028328 | A1 | 2/2006 | Cresse |
| 2006/0203493 | A1 | 9/2006 | Brower et al. |
| 2008/0074278 | A1 | 3/2008 | Anderson et al. |

OTHER PUBLICATIONS

International Search Report and Written Opinion for PCT/US2010/048368 issued Nov. 2, 2010. International Search Report and Written Opinion for PCT/US2010/048401 issued Nov. 3, 2010.

*Primary Examiner* — Thomas Sember
(74) *Attorney, Agent, or Firm* — King & Spalding LLP

(57) ABSTRACT

A ceiling notification device has a housing; a reflector unit mounted to the housing; a lens positioned over the reflector unit; and a lamp in the center of the reflector unit along the central axis. The reflector unit has a base, a plurality of reflective fins, and a surface portion. The base has a curved surface that is symmetrical about a central axis. The plurality of reflective fins each has a first fin portion extending from the base and a second fin portion extending from the base and the first fin portion, the second fin portion having an inner surface and an outer surface, wherein the inner surface is exposed to the central axis. The surface portion extends from the base and positioned between the first fin portion and an edge of the base and is angled toward an inner surface of the second fin portion.

23 Claims, 5 Drawing Sheets

OPTICALLY EFFICIENT NOTIFICATION DEVICE FOR USE IN LIFE SAFETY CEILING STROBE APPLICATIONS

TECHNICAL FIELD

The present application relates generally to a notification device for use in life safety ceiling strobe applications.

BACKGROUND

Life safety systems include notification devices positioned on walls and ceilings, as required by law. These notification devices can include a horn for an audible alert and/or a strobe for a visual alert. Notification devices draw energy to illuminate a strobe in a life safety application, such as a fire alarm or other signaling device. A notification device can be mounted on a surface, e.g., a wall or a ceiling, and aimed at the floor. The notification device has a reflector with internal reflecting surfaces to reflect light toward the specified space. The reflector can also have some external secondary reflector elements mounted on the reflector body.

Notification devices for the hearing impaired are governed by standards that require a polar light distribution off-axis at any given rated candela. In order to achieve the standard, the notification device must produce a minimum output at specified angles off-axis. For example, for a notification device to be rated at 177 candela, UL 1971 requires that the strobe has specific light intensities at viewing angles ranging from zero to 90 degrees off axis. UL 1971 requires a polar light distribution pattern to enhance the likelihood of alerting hearing impaired individuals throughout an area. The light intensity is measured in a horizontal and vertical direction and at viewing angles ranging from zero to +90 degrees and zero to −90 degrees. In one example, the UL polar distribution requires a percentage of the candela output at specific angles off-axis, e.g., five degrees off-axis requires an output of 90% of the rated on-axis value. So a 15 candela strobe is required to output 13.5 candela at five degrees off-axis.

It is desirable to use less energy, but the light output of the strobe must meet the requisite standards to achieve underwriting. As a result, the amount of energy is limited by the minimum required light output. The amount of current drawn by the notification device can be affected by various aspects of its configuration, including reflector design, electrical efficiency, lamp efficiency, efficiency of a metalized coating used for high reflectance, and the efficiency of the lens. It is desirable to adjust the properties of the notification device so that less current is needed to power the notification device while maintaining a required amount of light output.

SUMMARY

A notification device described herein can draw a lower current by providing a more efficient reflector configuration. The optically efficient reflector is generally a circular reflector having four symmetrical quadrants. The reflector is designed to be positioned on a ceiling and provide sufficient light output in each of the requisite directions, as required by the UL 1971 standard. For example, a notification device described herein can provide a 177 candela output using a 2.5 J flashtube lamp.

In one embodiment, a notification device comprises a housing configured to be installed on a ceiling; a reflector unit mounted to the housing; a lens coupled to the housing and positioned over the reflector unit; and a lamp positioned in the center of the reflector unit along the central axis. The reflector unit comprises a base, a plurality of reflective fins, and a surface portion. The base has a curved surface that is symmetrical about a central axis extending through the base. The plurality of reflective fins each comprise a first fin portion extending from the base and a second fin portion extending from the base and the first fin portion, the second fin portion having an inner surface and an outer surface, wherein the inner surface is exposed to the central axis. The surface portion extends from the base and positioned between the first fin portion and an edge of the base, wherein the surface portion is angled toward an inner surface of the second fin portion.

In another embodiment, a reflector unit for distributing light comprises a base, a plurality of reflective fins, and a surface portion. The base has a curved surface that is symmetrical about a central axis extending through the base. The plurality of reflective fins each comprise a first fin portion extending from the base and a second fin portion extending from the base and the first fin portion, the second fin portion having an inner surface and an outer surface, wherein the inner surface is exposed to the central axis. The surface portion extends from the base and positioned between the first fin portion and an edge of the base, wherein the surface portion is angled toward an inner surface of the second fin portion.

These and other aspects, objects, and features of the invention will become apparent to those having ordinary skill in the art upon consideration of the following detailed description of exemplary embodiments exemplifying the best mode for carrying out the invention as presently perceived.

BRIEF DESCRIPTION OF THE DRAWINGS

The objects and advantages of the invention will become apparent from the following detailed description of preferred embodiments thereof in connection with the accompanying drawings in which like numerals designate like elements and in which.

DETAILED DESCRIPTION

Figure 1A:
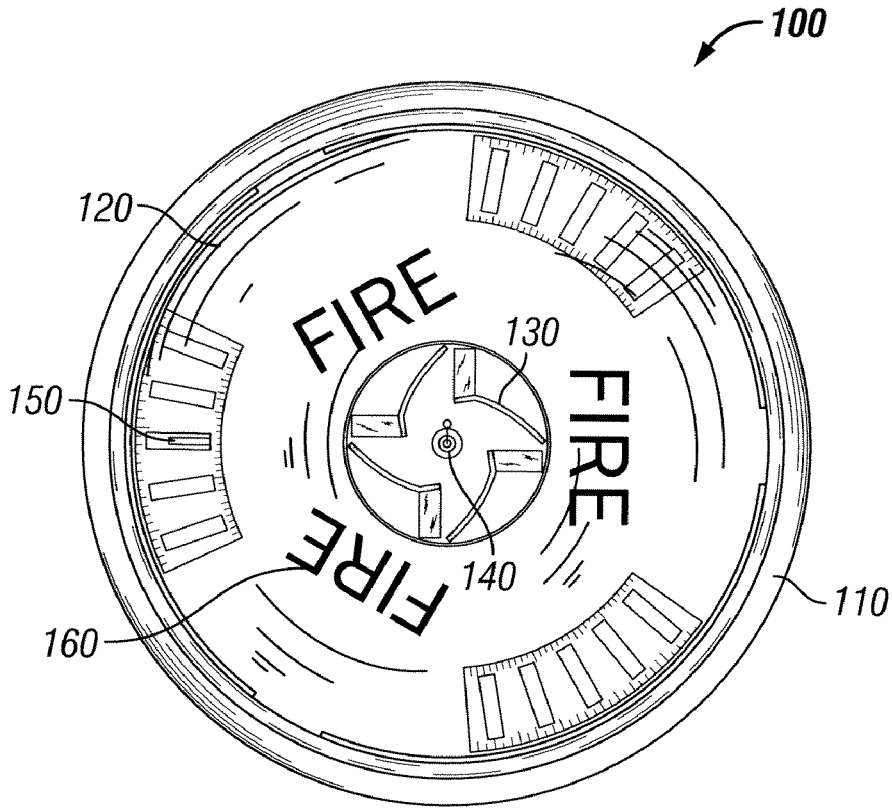
FIG. 1*a* is a frontal side view of a notification device according to an exemplary embodiment.

The present invention may be better understood by reading the following description of non-limitative embodiments with reference to the attached drawings wherein like parts of each of the several figures are identified by the same reference characters.

The notification device described herein can be adapted for operation under any one or combination of standards, such as UL 1971, and can be installed in different locations, such as a corridor, a sleeping room, or a non-sleeping room. Although the exemplary embodiments describe a notification device configured for a ceiling, it is intended that the notification device can be configured for use on a wall.

Figure 1B:
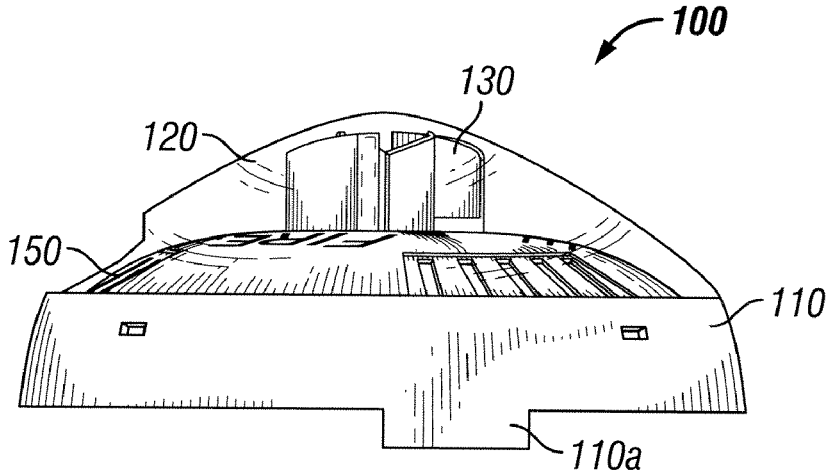
FIG. 1*b* is a side view of a notification device according to an exemplary embodiment.

Referring to FIGS. 1*a* and 1*b*, a notification device 100 for ceiling installation is shown. Notification device 100 has a housing 110 that can be mounted using a mounting plate to attach to a back box installed in a ceiling to provide any necessary electrical and mechanical connections. In this exemplary embodiment, housing 110 is shown to be round, but housing 110 can have any shape, e.g., rectangular. Mounting plate 110*a* attaches to housing 110 on the back side of the housing 100 that couples to the ceiling and can be used to secure and/or remove the housing 110 to the ceiling.

As shown in this exemplary embodiment, a lens 120 extends substantially across the face of the housing 110 and can extend substantially to the perimeter of the housing 110. A lens 120 extending substantially across the housing 110 can have a smoother contour to enhances optical performance. Light is more likely to pass straight through a flat surface than a curved surface. This configuration of the lens 120 can also give the appearance of a lower profile.

The lens 120 can cover the optical elements, such as a reflector unit 130 and a lamp 140, and horn elements, such as a speaker or piezo 150. Lettering or a graphic, such as "FIRE" 160 can be printed on the device 100. The lens 120 can cover the FIRE 160 to protect it from tampering. When using a lens that is colored or translucent, however, it may be desirable to locate the FIRE 160 outside of the lens 120. The housing 110 can also include a light intensity selector, which can be adjusted from the rear of the device 100, that has a window for viewing the selected intensity of the lamp in candela units. In order to prevent tampering, the candela intensity window (not shown) can also be placed under the lens 120. This lens configuration allows flexibility in locating the candela window within the lens perimeter to provide protection and good visibility. Near the piezo 150, the lens 120 has a series of apertures that align with the openings in the fascia for the piezo 150. In one embodiment, the lens 120 can wrap around each of the slot shown for piezo 150. As a result, sound from the piezo 150 is not distorted, inhibited, or obstructed by the lens 120. Although the lens 120 can be configured to entirely cover the piezo 150, it can be desirable to not cover the piezo 150 to allow for better sound distribution.

Figure 4A:
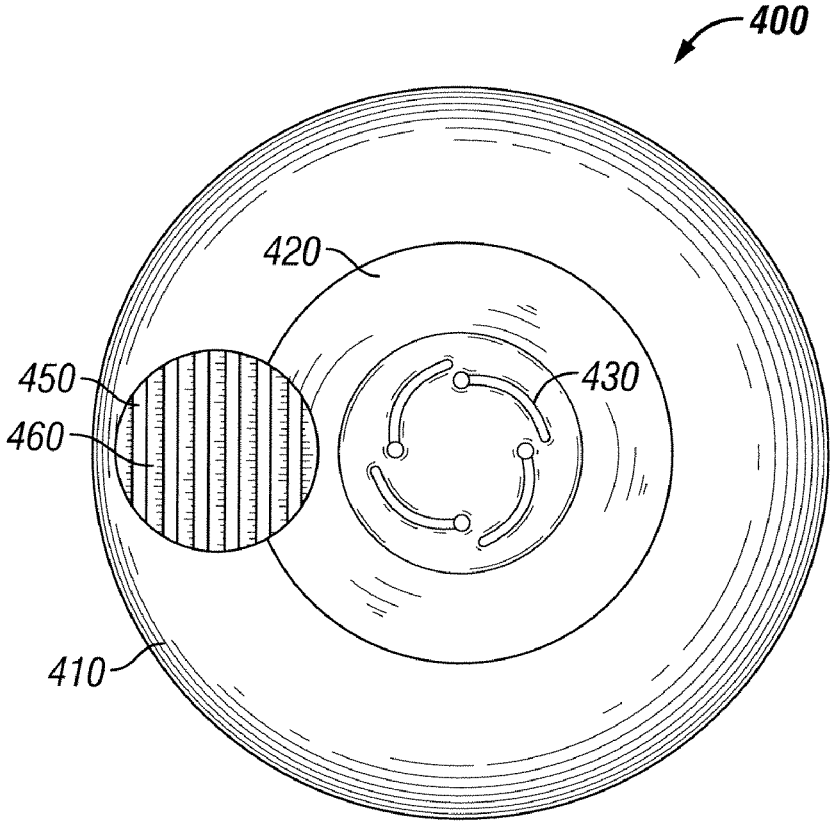
FIG. 4*a* a shows a frontal view of a notification device according to an exemplary embodiment.
Figure 4B:
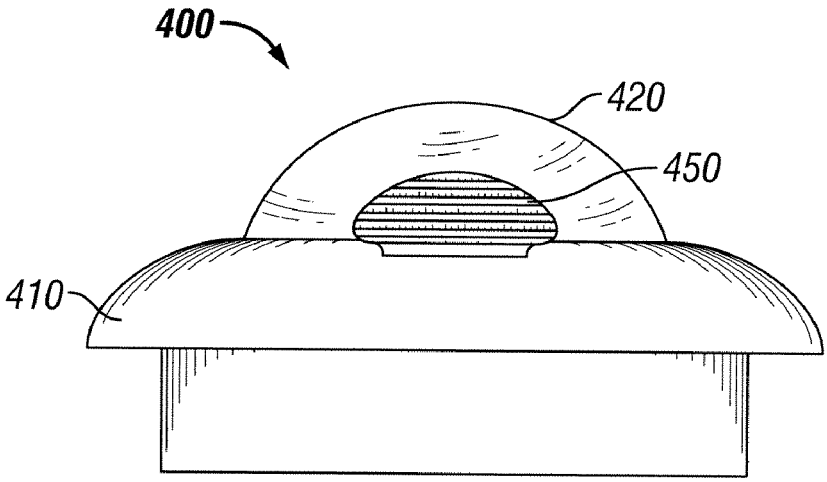
FIG. 4*b* shows a side view of a notification device according to an exemplary embodiment.

Alternatively, the lens can cover only the optical elements. Referring to FIGS. 4*a* and 4*b*, a notification device 400 is shown having a housing 410 and a lens 420. The lens 420 is configured to cover the optical elements, such as the reflector unit 430. A piezo 450 is not covered by the lens 420. Instead, the piezo can be positioned behind louvers 460. The louvers 460 are a plurality of narrow slots that can optionally be adjustable. In the particular embodiment shown, the piezo 450 is a circular shape and overlaps with a circular shape created by the lens 420. As a result, the lens 420 can be configured to extend around, but not over, the piezo 450.

In an exemplary embodiment, the lens can be made from a polycarbonate material for improved mechanical protection and flame retardant characteristics. The lens can be made of a transparent or opaque material. The lens can also have a color or hue, such as red, green blue, amber, or clear. In another embodiment, the lens can be transparent in only the area positioned over the optical elements, whereby the lens would still allow a complete light distribution pattern.

A reflector unit is installed in the housing and protected by the lens. In the exemplary embodiment described herein, the reflector has four symmetrical quadrants, though it is intended that the configuration can have more or less symmetrical segments, or the reflector unit can be designed so that it is not symmetrical. The reflector unit can be manufactured using a vacuum metalized injection-molded polycarbonate with UV resistant and scratch resistant lacquer.

Referring to FIG. 2, a perspective view of a reflector unit 200 is shown. Reflector unit 200 has two tabs 210*a*, each having a flange 210*b* at a distal end. Reflector unit 200 also has two tabs 210*c*. The tabs 210*a* can be inserted into a recess in the printed circuit board for securing the reflector unit 200 to the printed circuit board.

The reflector unit 200 has a base 220 having a substantially parabolic or freeform curvature shape that is symmetric about a central axis extending through the reflector unit, wherein the central axis is perpendicular to the plane of the ceiling. In one exemplary embodiment, the widest part of the base 220 at an edge 220*e* has a diameter of approximately 1 to 2 inches. For example, the base 220 can have a diameter of about 1.9 inches. The base 220 has a continuously smooth, specular surface that is designed to reflect a significant portion of direct light from a lamp to illuminate both the vertical and horizontal planes. The base 220 has an upper portion 220*a* and a lower portion 220*b*, each having a different curvature. The lower portion 220*b* forms a cavity that directs light from the lamp to the center of the reflector unit. The cavity can also double the intensity of the illumination effect on both horizontal and vertical planes. The base 220 can be installed in a housing whereby the edge 220*e* aligns with an exposed surface of the housing.

A lamp 230 is positioned in the center of the base 220 and extends in a direction along the central axis. The base 220 has a hole 220*c* and a notch 220*d* to accommodate the lamp 230 as well as any wires for connecting the lamp 230 to a circuit board (not shown), which can be positioned on the other side of the reflector unit 220. In connecting the lamp 230, a first electric connection points and solders to the circuit board beneath the reflector. A second electrical connection is connected to the other end of the lamp 230, threads through the notch 220*d*, and is coupled to the circuit board. A third electrical connection is attached to the middle of the lamp 230 and threaded through the hole 220*c* along with the lamp 230. The third electrical connection remains underneath the reflector. As shown in this exemplary embodiment, lamp 230 is a vertical flash tube that can be rated at 2.5 J. The lamp 230 can be a Xenon flashtube or any other suitable light source.

Figure 2A:
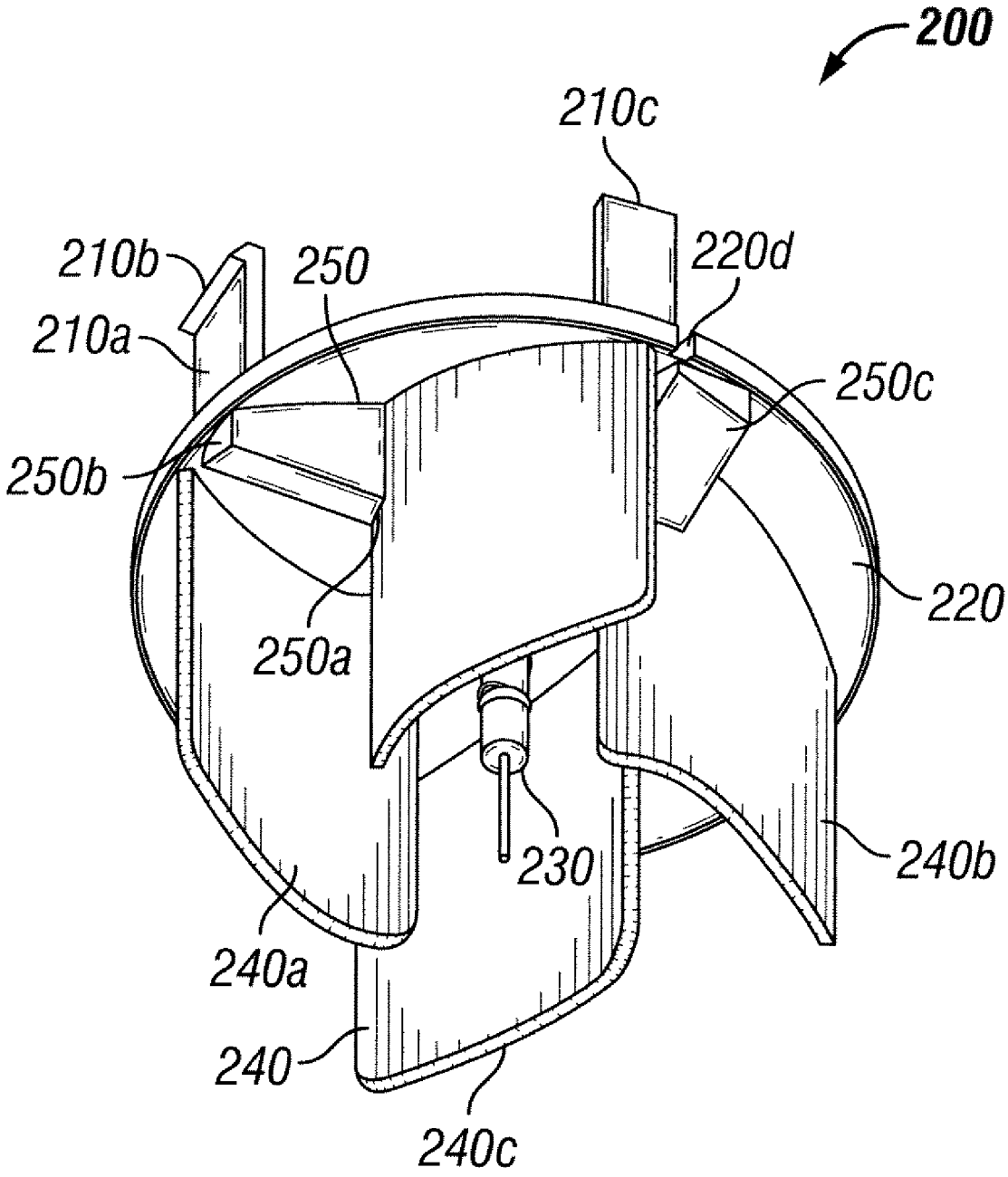
FIG. 2*a* is a perspective view of a reflector unit according to an exemplary embodiment.
Figure 2B:
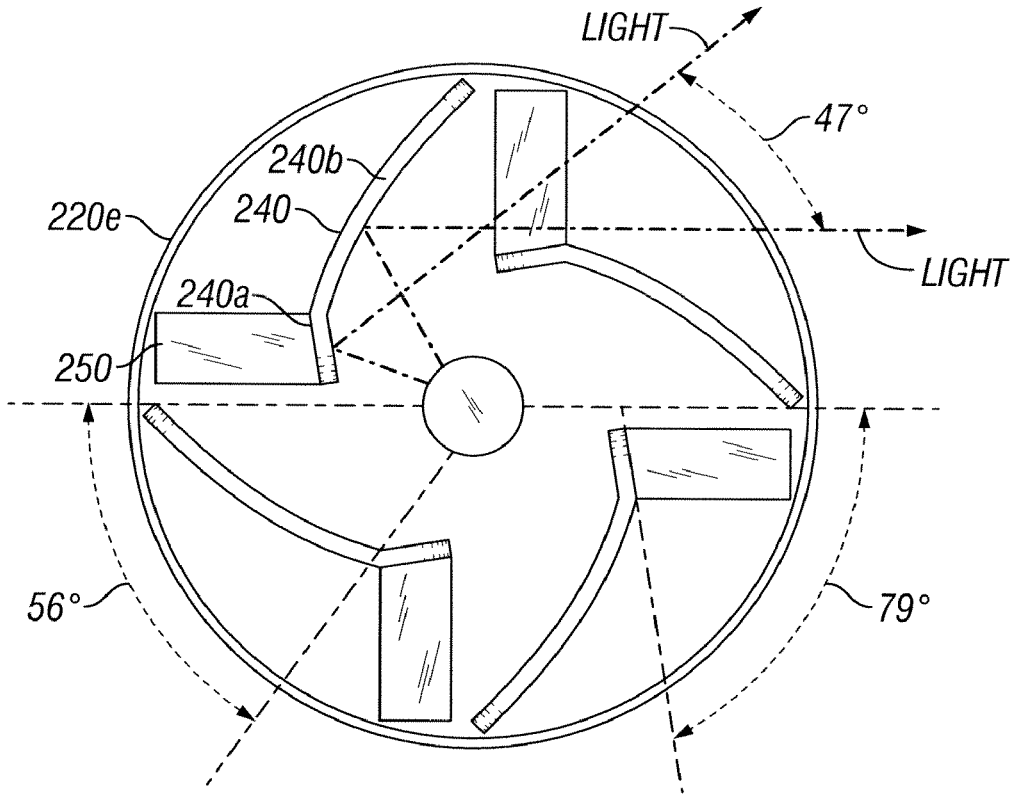
FIG. 2*b* is a frontal side view of a reflector unit according to an exemplary embodiment.
Figure 2C:
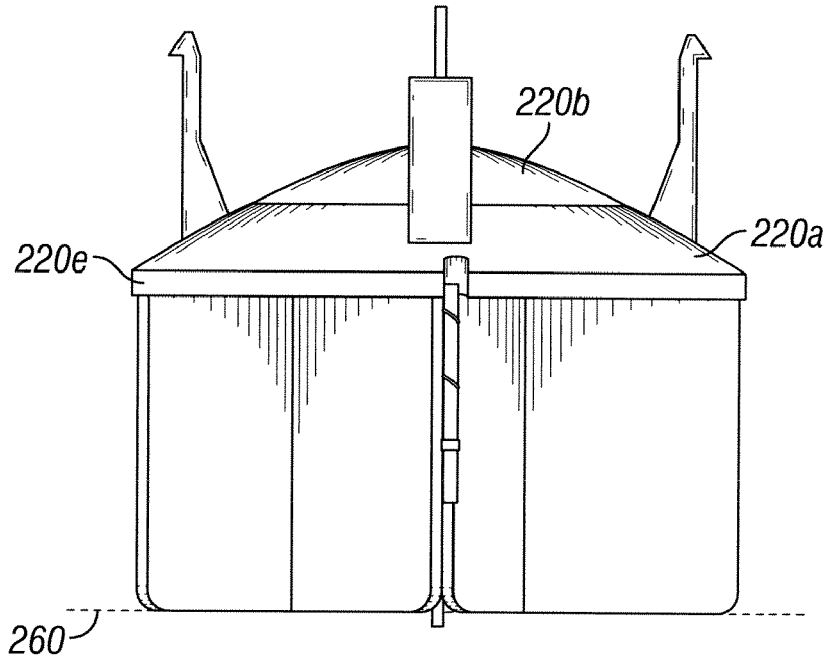
FIG. 2*c* is a side view of a reflector unit according to an exemplary embodiment.
Figure 2D:
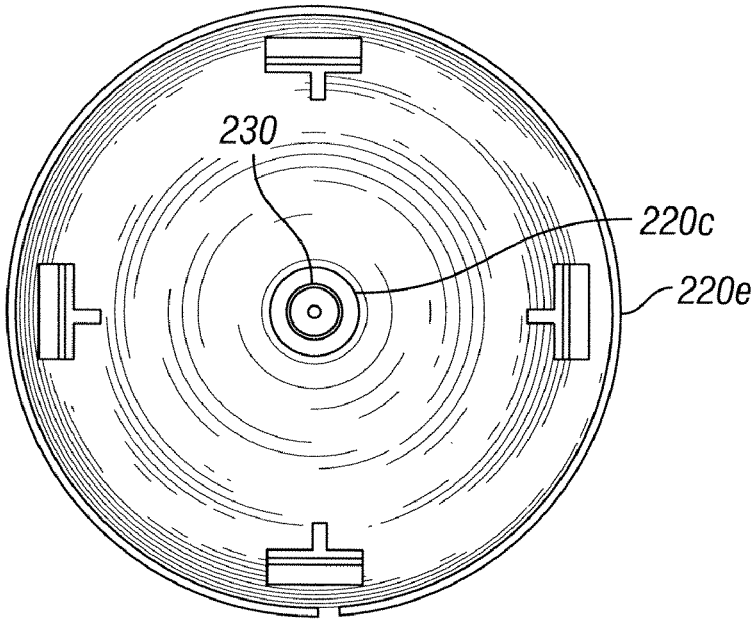
FIG. 2*d* is a rear side view of a reflector unit according to an exemplary embodiment.

Four reflective fins 240 extend from the base 220 and in a direction parallel to the central axis. The reflective fins 240 have a first fin portion 240*a* and a second fin portion 240*b*. The first fin portion 240*a* is substantially planar and extends from the lower portion 220*b* of base 220 to a position that is proximate the edge 220*e* of the upper portion 220*a*. First fin portion 240*a* directs light at about 45 degrees between the horizontal and vertical planes. Each second fin portion 240*b* directs light from about 25 to 90 degrees along the horizontal and vertical planes in one of the four quadrants. As shown in FIG. 2*b*, light reflected from the first fin portion 240*a* is about 47 degrees from the light reflected from the second fin portion 240*b*. In the exemplary embodiment, referring to FIG. 2*b*, the first fin portion 240*a* is angled at about 79 degrees from a horizontal plane.

The second fin portion 240*b* extends from the first fin portion 240*a* substantially toward the edge of the base 220. The second fin portion 240*b* is slightly curved and extends away from the first fin portion 240*a* in a direction such that an inner surface of the reflective fin 240 substantially faces the lamp 230. As shown in FIG. 2*b*, the second fin portion 240*b* extends about 56 degrees about the central axis. The combination of the four reflective fins 240 substantially surrounds the lamp 230.

Figure 3:
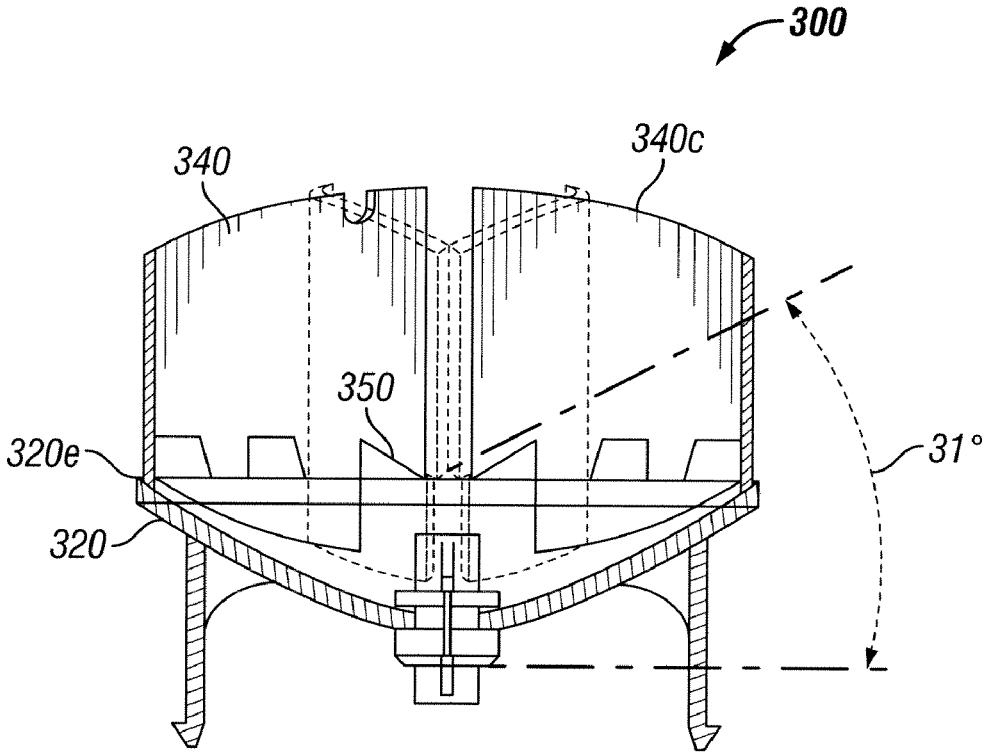
FIG. 3 is a cross-sectional view of a reflector unit according to an alternative exemplary embodiment.

In an exemplary embodiment, the fins 240 can extend about 1 inch, as measured from the plane of an edge 220*e* of the base 220. The reflective fins 240 can extend from the base 220 to a plane 260 parallel to the ceiling and perpendicular to the central axis. In an alternative embodiment, the reflective fins 240 extend further along the central axis and decrease in length as the reflective fins 240 extend radially outwards. As shown in the cross-sectional view of a reflector unit 300 in FIG. 3, reflective fins 340 can have an upper edge 340*c* in the form of a parabolic curve or have other curvature. In this embodiment, the fins 340 can extend about 1 inch near the central axis, but do not extend as much near an edge 320*e* of the base 320.

Four reflective surface portions 250 extend from the upper portion 220*a* of the base 220 in a direction generally along the central axis. A first end 250*a* of the surface portion 250 abuts the first fin portion 240*a*. The surface portion 250 tapers to a second end 250*b* substantially at the edge 220*e* of the base 220. An upper surface 250*c* of the surface portion 250 is tilted towards an inner surface of the second fin portion 240*b*. Referring to the exemplary embodiment shown in FIG. 3, a surface portion 350 is tilted at about 31 degrees. The surface portion 250 directs a secondary reflection from second fin portion 240*b* to about 25 degrees on the horizontal and vertical planes. The base 220 directs light along the central axis and up to about 25 degrees in all directions.

When the lamp 230 is illuminated, the light from the lamp 230 reflects off the base 220, the first fin portion 240*a*, and the second fin portion 240*b*, as well as in the direction of the floor and walls of a specified space. Light reflects from the first fin portion 240*a* and the second fin portion 240*b* to the base 220 and the surface portion 250, as well as in the direction of the floor and walls. The surface portion 250 also directs light toward the floor and walls. As a result, the notification device can achieve the polar light distribution pattern required by UL 1971.

The notification device incorporating this reflector has a greater optical efficiency than a conventional strobe having a 177 candela output. The efficiency allows for a reduction in power needed to operate the lamp. This reduction in lamp wattage translates into a lower current rating for the appliance. While a conventional 177 candela strobe may need to expend as much as 4.5 J of electrical energy for the strobe to meet the UL 1971 requirements for 150 candela and 177 candela settings, the notification device described herein can achieve the UL 1971 standard with only 2.5 J of energy expended by the flashtube at both 150 candela and 177 candela, which is almost a doubling in optical efficiency. Rather than using two separate models of notification devices for low candela (e.g., 15, 30, 75, and 95 candela) and high candela (e.g., 150 and 177 candela), a single notification device described herein can be used in all ceiling applications from about 15 to 177 candela output. For example, the notification device can be set via a switch to 15, 30, 60, 75, 95, 115, 150, and 177 candela.

Because the notification device allows for a lower energy flash-tube, high and low intensity strobes can use the same lower energy flash tube and can therefore be combined into one unit. This reduces cost as the lower energy tube is not as expensive as the higher energy one and it also reduces the number of product models or variations, i.e., Stock Keeping Units ("SKU") reduction. As a result, customers only need to purchase one type of notification device, eliminating any confusion or mistaken purchases of the wrong device. Also, managing one model is easier for distribution and stocking purposes.

Although the exemplary embodiment recites a 177 candela output, it is intended that the reflector unit can be configured for other candela outputs, such as 110 candela. The light output can be adjusted electrically by lowering or raising the energy to the lamp from about 0.6 J to about 2.5 J. The configuration of the reflector unit can be adjusted to affect the amount of reflected light from the lamp, such as reducing the size of the base for a lower light distribution, reconfiguring the base to accommodate a larger lamp, or increasing or decreasing the surface area of any component, such as by varying the size of the upper and/or lower portions of the base.

Therefore, the present invention is well adapted to attain the ends and advantages mentioned as well as those that are inherent therein. The particular embodiments disclosed above are illustrative only, as the present invention may be modified and practiced in different but equivalent manners apparent to those having ordinary skill in the art having the benefit of the teachings herein. While numerous changes may be made by those having ordinary skill in the art, such changes are encompassed within the spirit and scope of this invention as defined by the appended claims. Furthermore, no limitations are intended to the details of construction or design herein shown, other than as described in the claims below. It is therefore evident that the particular illustrative embodiments disclosed above may be altered or modified and all such variations are considered within the scope and spirit of the present invention as defined by the claims below. The terms in the claims have their plain, ordinary meaning unless otherwise explicitly and clearly defined by the patentee.

What is claimed is:

1. A notification device comprising:

a housing configured to be installed on a ceiling;

a reflector unit mounted to the housing, the reflector unit comprising:

a base having a reflective curved surface, wherein a curvature of the curved surface is symmetrical about a central axis extending through the base;

a plurality of reflective fins, wherein each reflective fin comprises:

a first fin portion extending from the curved surface of the base; and a second fin portion extending from the curved surface of the base and the first fin portion, the second fin portion having an inner surface and an outer surface, wherein the inner surface is exposed to the central axis; and a surface portion extending from the curved surface of the base and positioned between the first fin portion and an edge of the base, wherein the surface portion is angled toward an inner surface of the second fin portion;

a lens coupled to the housing and positioned over the reflector unit; and a lamp positioned in the center of the reflector unit along the central axis.

2. The notification device according to claim 1, wherein the base comprises an upper portion and a lower portion, wherein the upper portion and the lower portion each have a different curvature.

3. The notification device according to claim 1, wherein the reflective fins extend further near the central axis than at the edge of the base.

4. The notification device according to claim 1, wherein an upper edge of the reflective fins extend to a plane perpendicular to the central axis.

5. The notification device according to claim 1, wherein the second fin portion is curved.

6. The notification device according to claim 1, wherein the surface portion substantially tapers from the first fin portion to the edge of the base based upon the curvature of the upper portion of the base.

7. The notification device according to claim 1, wherein the lamp is a 2.5 J flashtube.

8. The notification device according to claim 1, wherein the notification device is configured to provide a 177 candela output with a 2.5 J lamp.

9. The notification device according to claim 1, wherein the lens extends to an outer perimeter of the housing.

10. The notification device according to claim 9, further comprising a horn element, wherein the lens has at least one aperture positioned substantially over the horn element.

11. The notification device according to claim 1, further comprising a horn element, wherein the horn element is positioned within the housing and behind a plurality of louvers disposed on a surface of the housing.

12. The notification device according to claim 9, further comprising:

a horn element disposed within the housing and comprising a plurality of apertures disposed along a surface of the housing;

wherein the lens comprises a plurality of apertures disposed along a surface of the lens, wherein the plurality of aperture in the lens are aligned with the plurality of apertures disposed along the surface of the housing.

13. The notification device of claim 1, wherein a height of the surface portion tapers down from the first fin portion to the edge of the base such that the height of the surface portion adjacent the first fin portion is greater than the height of the surface portion adjacent to the edge of the base.

14. A reflector unit for distributing light, the reflector unit comprising:

a base having a reflective curved surface, wherein a curvature of the curved surface is symmetrical about a central axis extending through the base, and wherein the base is configured to accommodate a lamp;

a plurality of reflective fins, wherein each reflective fin comprises:

a first fin portion extending from the reflective curved surface of the base; and a second fin portion extending from the reflective curved surface of the base and the first fin portion, the second fin portion having an inner surface and an outer surface, wherein the inner surface is exposed to the central axis; and a surface portion extending from the reflective curved surface of the base and positioned between the first fin portion and an edge of the base, wherein the surface portion is angled toward an inner surface of the second fin portion.

15. The reflector unit according to claim 14, wherein the reflective curved surface of the base comprises an upper portion and a lower portion, wherein the upper portion and the lower portion each have a different curvature.

16. The reflector unit according to claim 14, wherein the reflective fins extend further near the central axis than at the edge of the base.

17. The reflector unit according to claim 14, wherein an upper edge of the reflective fins extend to a plane perpendicular to the central axis.

18. The reflector unit according to claim 14, wherein the second fin portion is curved.

19. The reflector unit according to claim 14, wherein the surface portion substantially tapers from the first fin portion to the edge of the base based upon the curvature of the upper portion of the base.

20. The reflector unit according to claim 14, wherein the base, reflective fins, and surface portion are reflective.

21. The reflector unit according to claim 14, wherein each of the plurality of reflective fins extend about 56 degrees about the central axis.

22. The reflector unit according to claim 14, wherein the reflector unit is configured to provide a 177 candela output with a 2.5 J lamp.

23. A notification device comprising:

a housing;

a reflector unit mounted to the housing, the reflector unit comprising:

a base having a reflective_ curved surface, wherein a curvature of the curved surface is symmetrical about a central axis extending through the base;

a plurality of reflective fins, each reflective fin comprising:

a first fin portion extending from the curved surface of the base and comprising an inner surface and an outer surface, wherein the inner surface of the first fin portion is exposed to the central axis; and a second fin portion extending from the curved surface of the base and the first fin portion, the second fin portion having an inner surface and an outer surface, wherein the inner surface of the second fin portion is exposed to the central axis; and a surface portion extending from the curved surface of the base and abutting outer surface of the first fin portion, wherein the first fin portion is disposed between the central axis and the surface portion and shields the surface portion from being exposed to the central axis, a lens coupled to the housing and positioned over the reflector unit; and a lamp positioned in the center of the reflector unit along the central axis.

* * * * *